US009533862B2

(12) United States Patent
Ho

(10) Patent No.: US 9,533,862 B2
(45) Date of Patent: Jan. 3, 2017

(54) CABLE GUIDE ASSEMBLY

(71) Applicant: Jim Ho, Chiayi County (TW)

(72) Inventor: Jim Ho, Chiayi County (TW)

( * ) Notice: Subject to any disclaimer, the term of this patent is extended or adjusted under 35 U.S.C. 154(b) by 350 days.

(21) Appl. No.: 14/335,824

(22) Filed: Jul. 18, 2014

(65) Prior Publication Data

US 2016/0016766 A1 Jan. 21, 2016

(51) Int. Cl.
*B66D 1/36* (2006.01)
*B66D 1/38* (2006.01)

(52) U.S. Cl.
CPC ..... *B66D 1/38* (2013.01)

(58) Field of Classification Search
CPC ..... B66D 1/36; B66D 1/38; B66D 1/50; B66D 1/52; B66D 2700/0191
See application file for complete search history.

(56) References Cited

U.S. PATENT DOCUMENTS 2,453,184 A * 11/1948 Berry ..... B66D 1/36 242/157.1
2,660,382 A * 11/1953 Hart ..... B66D 1/36 242/157.1
3,309,064 A * 3/1967 Wolf ..... B66D 1/28 254/286
3,809,334 A * 5/1974 Beurer ..... B64D 1/22 242/390.2
3,825,197 A * 7/1974 Sturgeon ..... B65H 54/2812 242/419.5
4,455,961 A * 6/1984 Hansen ..... B66D 1/38 114/242
4,892,262 A * 1/1990 Hurst ..... B66D 1/38 242/157.1
5,002,238 A * 3/1991 Inhofer ..... B66D 1/36 242/156.1
7,111,803 B2 * 9/2006 Mott ..... B66D 1/38 242/397.4
2005/0116079 A1 * 6/2005 Stevens ..... B60D 1/185 242/419.5
2009/0207250 A1 * 8/2009 Bennett ..... F16M 11/105 348/144
2011/0168961 A1 * 7/2011 Christiansen ..... B66D 3/006 254/327

(Continued)

FOREIGN PATENT DOCUMENTS

AT WO 0112536 A1 * 2/2001 ..... B66D 1/38
AU CA 2813034 A1 * 4/2012 ..... B66D 1/30

(Continued)

*Primary Examiner* — Emmanuel M Marcelo
(74) *Attorney, Agent, or Firm* — DLA Piper LLP (US)

(57) ABSTRACT

A cable guide assembly is used in a winch device having a rotatable cable shaft and a cable wound on the cable shaft. The cable guide assembly includes a support unit, a holding unit, and a coupling unit. The support unit includes a support member formed with a cable hole for extension of the cable therethrough, and two roller rods disposed rotatably within the support member and disposed at opposite sides of the cable. Each roller rod has a portion exposed from the cable hole of the support member. The holding unit is disposed at a side of the support unit opposite to the cable shaft and is used for stretching taut a portion of the cable between the cable shaft and the holding unit. The coupling unit interconnects the holding unit and the support member.

8 Claims, 5 Drawing Sheets

(56) References Cited

U.S. PATENT DOCUMENTS

| | | | | |
|---|---|---|---|---|
| 2011/0168962 | A1 * | 7/2011 | Yang | B66D 3/006<br>254/400 |

FOREIGN PATENT DOCUMENTS

| | | | | |
|---|---|---|---|---|
| DE | EP 0354320 | A1 * | 2/1990 | B66D 1/38 |
| DE | 2020141051 | U1 * | 12/2014 | B66D 1/36 |
| SI | WO 2015069193 | A1 * | 5/2015 | B66D 1/36 |

* cited by examiner

CABLE GUIDE ASSEMBLY

BACKGROUND OF THE INVENTION

1. Field of the Invention

This invention relates to a cable guide assembly, more particularly to a cable guide assembly adapted for use in a winch.

2. Description of the Related Art

A winch is a device that has a cable and that is used for pulling or lifting objects.

Referring to FIG. 1, a conventional winch device 1 includes a power unit 11 and a roller unit 12 spaced apart from the power unit 11. The power unit 11 includes a motor 111 and a shaft 112 driven rotatably by the motor 111. A steel cable 13 is at least partly wound on the shaft 112. The roller unit 12 includes a main body 121, and two roller rods 122 that are spaced apart from each other and that are disposed rotatably within the main body 121. The main body 121 and the roller rods 122 cooperatively define a cable hole 123 allowing a portion of the steel cable 13 which is not wound on the shaft 112 to pass therethrough.

By controlling forward or reverse rotation of the motor 111, the steel cable 13 can be wound on or released from the shaft 112. While the motor 111 is in forward rotation, the steel cable 13 needs to be manually held by a user and controlled in order to be evenly wound on the shaft 112. Since the steel cable 13 includes steel wires (not shown) twisted together, constant abrasion may break parts of the steel wires after long-term use of the steel cable 13. The untangled steel wires may injure the user's hands even when the user wears safety gloves.

SUMMARY OF THE INVENTION

Therefore, the object of this invention is to provide a cable guide assembly that can be easily attached to and detached from a cable of a winch and that can improve safety during operation of the winch.

According to the present invention, a cable guide assembly is adapted for use in a winch device. The winch device includes a rotatable cable shaft and a cable wound on the cable shaft. The cable guide assembly includes a support unit, a holding unit, and a coupling unit. The support unit includes a support member and two roller rods. The support member is spaced apart from the cable shaft in a first direction and extends in a second direction different from the first direction. The support member is formed with a cable hole for extension of the cable therethrough. The roller rods are disposed at opposite sides of the cable. Each of the roller rods is disposed rotatably within the support member and extends in the second direction. A portion of each of the roller rods is exposed from the cable hole of the support member. The holding unit is disposed at a side of the support unit that is opposite to the cable shaft for stretching taut a portion of the cable between the cable shaft and the holding unit. The holding unit includes a main body that defines a receiving space and a cable opening that is in spatial communication with the receiving space. The receiving space is adapted for extension of another portion of the cable therethrough. The cable opening is disposed at a lateral side of the another portion of the cable received in the receiving space and that is adapted for insertion of the cable into and withdrawal of the cable from the receiving space therethrough. The coupling unit interconnects the main body of the holding unit and the support member of the support unit.

BRIEF DESCRIPTION OF THE DRAWINGS

Other features and advantages of the present invention will become apparent in the following detailed description of a preferred embodiment of this invention, with reference to the accompanying drawings, in which.

DETAILED DESCRIPTION OF THE PREFERRED EMBODIMENT

Figure 1:
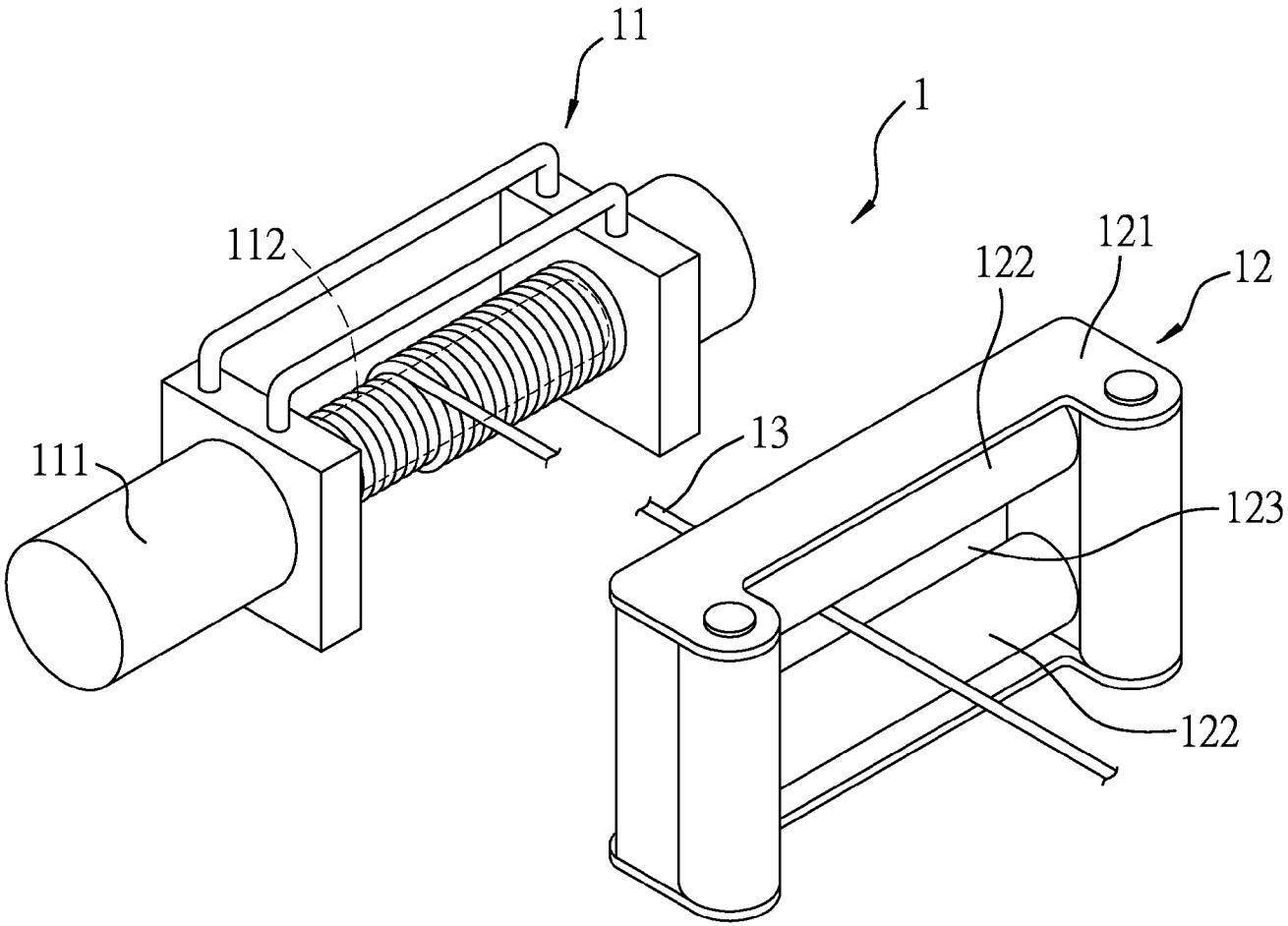
FIG.1 PRIOR ART
FIG. 1 is a fragmentary perspective view of a conventional winch.
Figure 2:
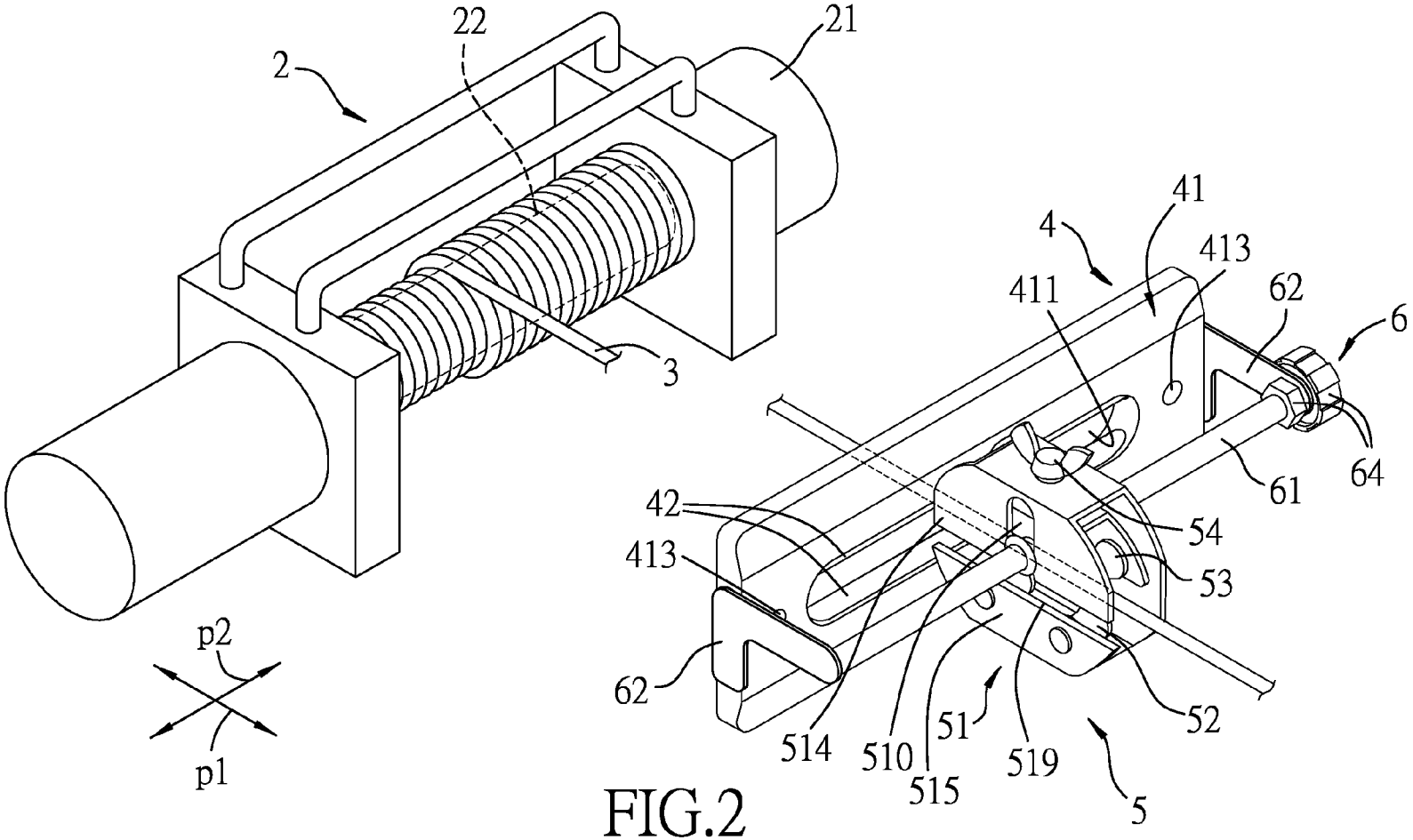
FIG. 2 is a fragmentary perspective view of winch which provided with a preferred embodiment of a cable guide assembly according to the present invention.
Figure 3:
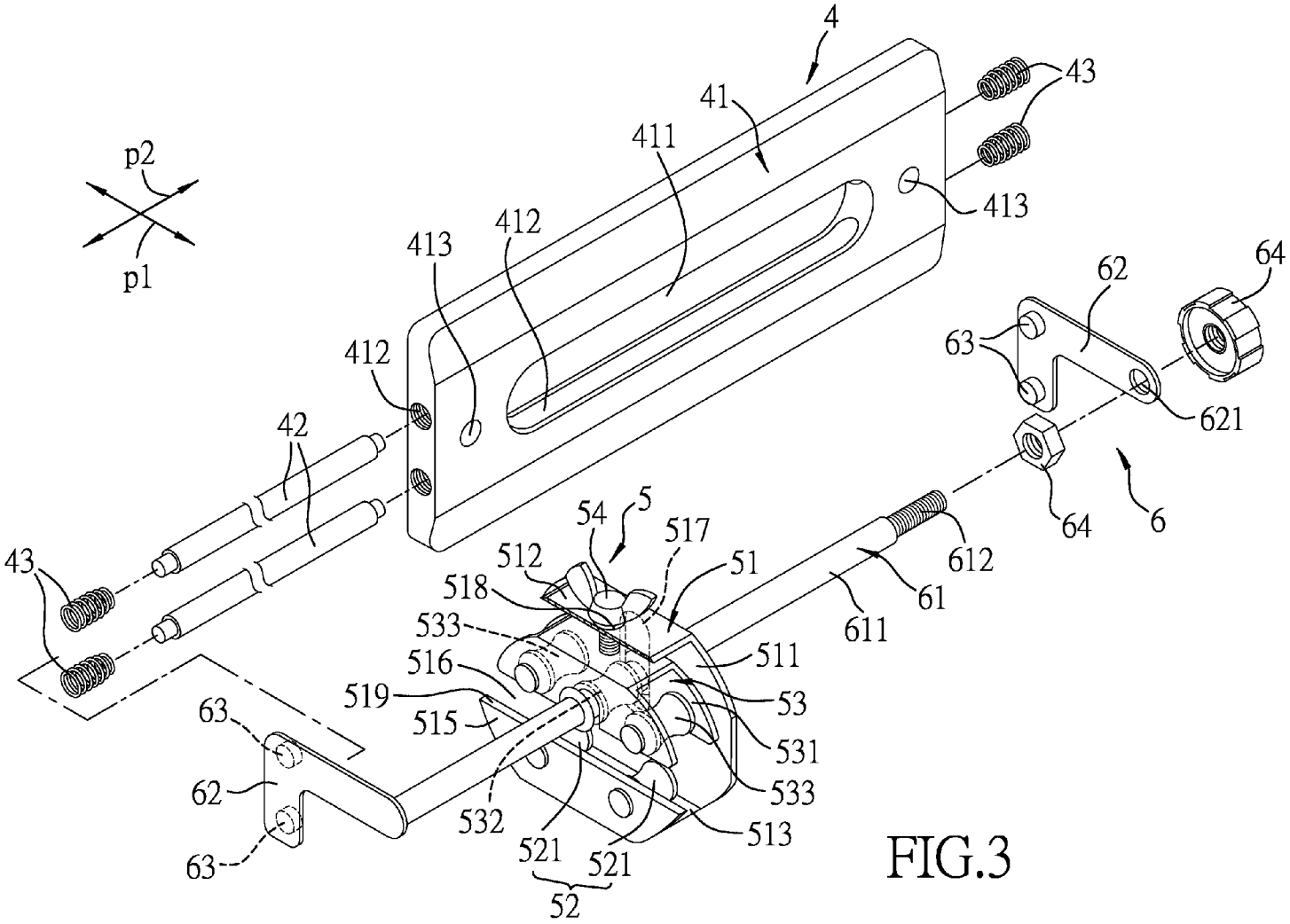
FIG. 3 is a fragmentary partly exploded perspective view of the preferred embodiment.
Figure 4:
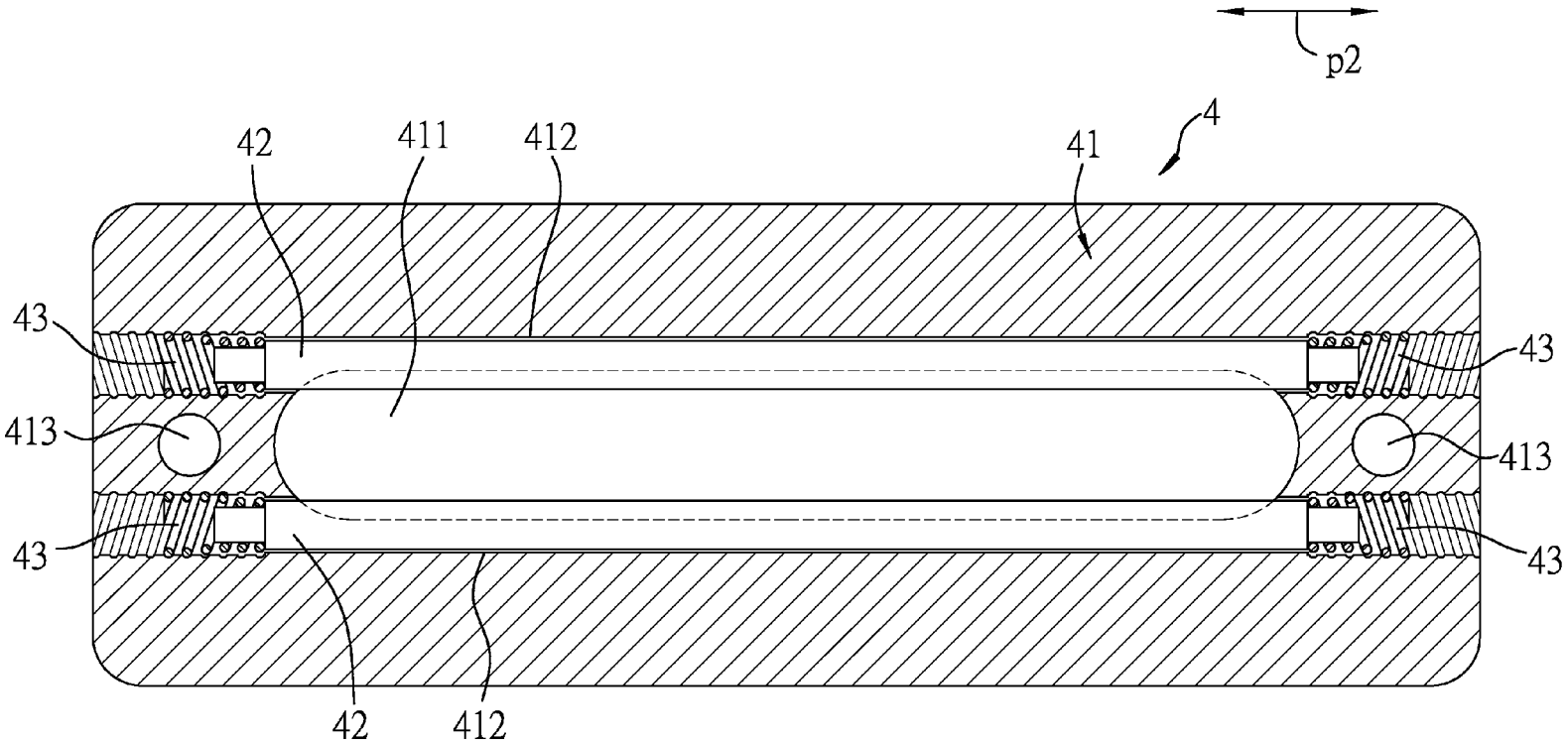
FIG. 4 is a partly sectional view of a support unit of the present invention.

FIGS. 2 to 4 illustrate a preferred embodiment of a cable guide assembly of the present invention. The cable guide assembly is adapted for use in a winch device 2 that can be installed on a ship, a vehicle, a building, etc. for pulling or feeding a cable 3. In this embodiment, the cable 3 is made of steel wires. However, the cable 3 may be made of hemp, cotton, synthetic fiber, etc. The winch device 2 includes a motor 21 and a rotatable cable shaft 22. By controlling forward or reverse rotation of the motor 21, the cable 3 is wound on or released from the cable shaft 22.

The cable guide assembly includes a support unit 4, a holding unit 5, and a coupling unit 6. The support unit 4 includes a support member 41, two roller rods 42, and four positioning members 43. The support member 41 is spaced apart from the cable shaft 22 in a first direction (p1) and is formed as a rectangular plate extending in a second direction (p2). In this embodiment, the first and second directions (p1, p2) are different horizontal directions perpendicular to each other. The support member 41 is formed with a cable hole 411 for the cable 3 to extend therethrough. The support member 41 of the support unit 4 is further formed with two engaging holes 412 extending therethrough in the second direction (p2) and being in spatial communication with the cable hole 411. Specifically, the engaging holes 412 are vertically spaced apart from each other, and are respectively in spatial communication with vertically opposite end portions of the cable hole 411. The two roller rods 42 extend in the second direction (p2) and are respectively and rotatably received in the two engaging holes 412. As such, the roller rods 42 are disposed at vertically opposite sides of the cable 3. Each of the roller rods 42 has a portion exposed from the cable hole 411 of the support member 41 and in rotatable contact with the cable 3. In this embodiment, each of the engaging holes 412 has opposite hole end portions that are formed respectively with an internal thread. Two of the positioning members 43 are spaced apart from each other in the second direction (p2), are threaded respectively into the opposite hole end portions of one of the engaging holes 412, and cooperatively retain a corresponding one of the roller rods 42 therebetween. The other two of the positioning members 43 are spaced apart from each other in the second direction (p2), are threaded respectively into the opposite hole end portions of the other one of the engaging holes 412, and cooperatively retain a corresponding one of the roller rods 42 therebetween. In this embodiment, each of the positioning members 43 is a frustoconical coil spring that has a small-diameter end abutting against a corresponding one of the roller rods 42, and a large-diameter end opposite to the small-diameter end.

In this embodiment, the support member 41 of the support unit 4 is further formed with two mounting holes 413 spaced apart from each other in the second direction (p2). Each of the mounting holes 413 extends through the support member 41 in the first direction (p1). The support unit 4 can be fastened to an object using two screws extending through the mounting holes 413 and threadedly into the object.

Figure 5:
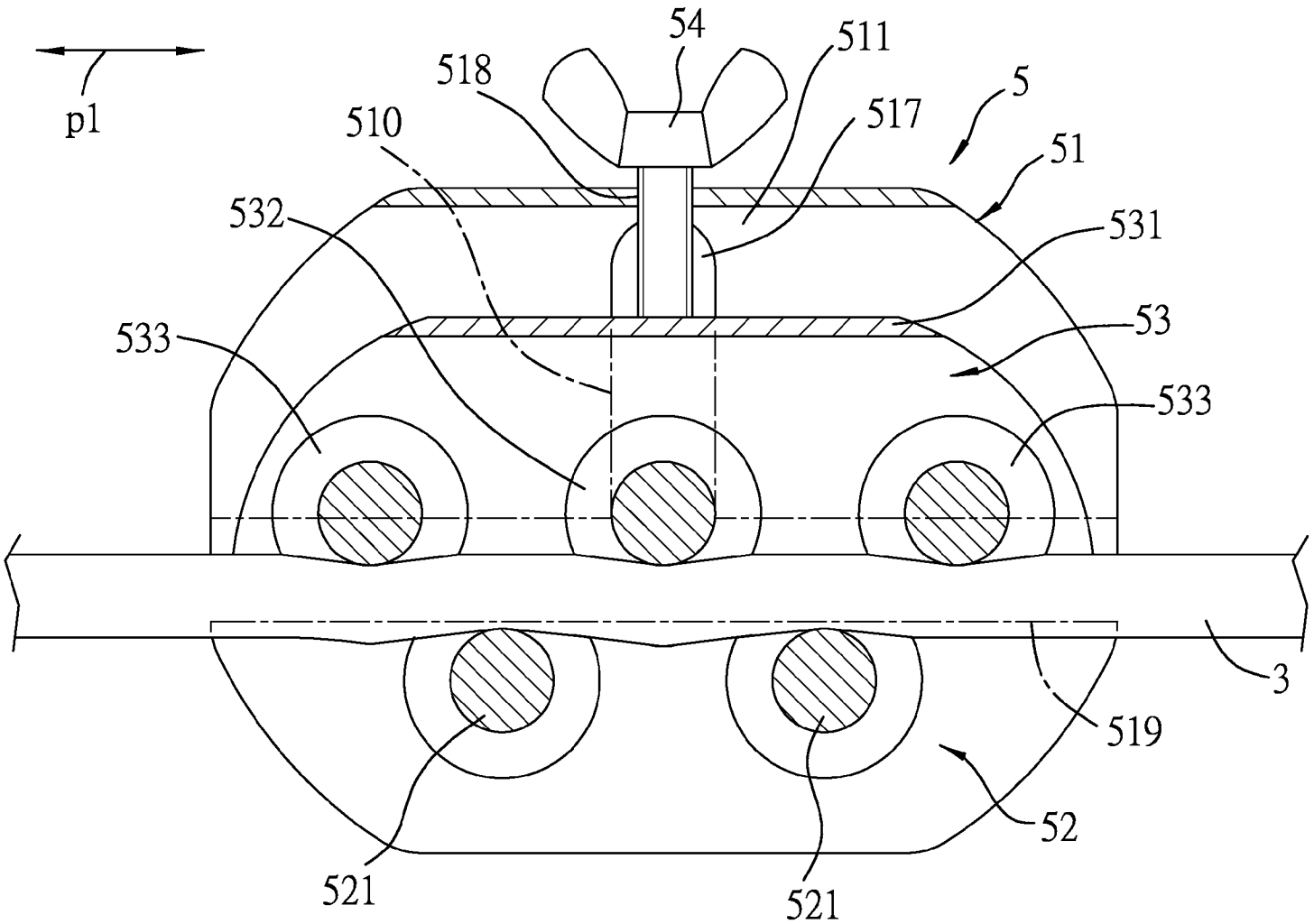
FIG. 5 is a partly sectional view of a holding unit of the preferred embodiment.

Referring further to FIG. 5, the holding unit 5 is disposed at a side of the support unit 4 opposite to the cable shaft 22 in the first direction (p1) for stretching taut a portion of the cable 3 between the cable shaft 22 and the holding unit 5. The holding unit 5 includes a main body 51, a first guide roller module 52, a second guide roller module 53, and a threaded member 54.

The main body 51 of the holding unit 5 includes a base wall 511, first and second connecting walls 512, 513, and first and second extending walls 514, 515. The base wall 511 has vertically opposite ends. The first and second connecting walls 512, 513 extend respectively from the opposite ends of the base wall 511 in the second direction (p2). The first and second extending walls 514, 515 extend vertically and respectively from distal ends of the first and second connecting walls 512, 513 toward each other. The base wall 511, the first and second connecting walls 512, 513, and the first and second extending walls 514, 515 cooperatively define a receiving space 516 for extension of another portion of the cable 3 therethrough.

The first and second extending walls 514, 515 cooperatively define a cable opening 519 that is in spatial communication with the receiving space 516. The cable opening 519 is disposed at a lateral side of the another portion of the cable received in the receiving space. The cable 3 can be inserted into or withdrawn from the receiving space 516 through the cable opening 519. The first extending wall 514 is disposed over the cable opening 519 and is formed with an open groove 510 that is in spatial communication with the cable opening 519. The base wall 511 is formed with a through hole 517 that is registered with the open groove 510 in the second direction (p2) and that is in spatial communication with the receiving space 516. The first connecting wall 512 is formed with a threaded hole 518 that is in spatial communication with the receiving space 516.

In this embodiment, the first guide roller module 52 is disposed in the receiving space 516 of the main body 51 and includes two rotatable first guide rollers 521 spaced apart from each other in the first direction (p1). The second guide roller module 53 includes a mounting seat 531 disposed in the receiving space 516 of the main body 51, and a rotatable main roller 532 and two rotatable second guide rollers 533 mounted on the mounting seat 531. The second guide rollers 533 are disposed respectively at opposite sides of the main roller 532 in the first direction (p1). The main roller 532, the two second guide rollers 533, and the two first guide rollers 521 cooperatively clamp the cable 3 thereamong.

The threaded member 54 extends threadedly through the threaded hole 518 and abuts against the mounting seat 531 of the second guide roller module 53.

The coupling unit 6 interconnects the main body 51 of the holding unit 5 and the support member 41 of the support unit 4. The coupling unit 6 includes a coupling shaft 61, two coupling walls 62, four engaging protrusions 63, and two nuts 64. The coupling shaft 61 has a main shaft section 611 and a threaded section 612 connected to an end of the main shaft section 611. The main shaft section 611 of the coupling shaft 61 extends in the second direction (p2) through the main roller 532, the open groove 510 of the first extending wall 514, the mounting seat 531, and the through hole 517 of the base wall 511. The holding unit 5 is slidable along the main shaft section 611 of the coupling shaft 61. The coupling shaft 61 is vertically movable along the through hole 517 of the base wall 511, so that the first guide roller module 52 is vertically movable together with the coupling shaft 61 relative to the second guide roller module 53, and that the threaded member 54 is operable to adjust a vertical position of the second guide roller module 53 relative to the first guide roller module 52. In this embodiment, the coupling walls 62 are L-shaped and are spaced apart from each other in the second direction (p2). One of the coupling walls 62 is formed with an open hole 621 engaged with the threaded section 612 of the coupling shaft 61, and is fixed on the threaded section 612 of the coupling shaft 61 with the two nuts 64 that are screwed onto the threaded section 612. The other one of the coupling walls 62 is welded to an end of the main shaft section 611 of the coupling shaft 61 opposite to the threaded section 612.

Two of the engaging protrusions 63 protrude respectively from the coupling walls 62 toward each other and into the opposite hole end portions of one of the engaging holes 412. The other two of the engaging protrusions 63 protrude respectively from the coupling walls 62 toward each other and into the opposite hole end portions of the other one of the engaging holes 412.

Referring to FIGS. 2, 3, 4, when installing the embodiment of the present invention, each of the roller rods 42 is inserted into a corresponding one of the engaging holes 412 of the support member 41. Each of the positioning members 43 is respectively and threadedly inserted into a corresponding one of the hole end portions of the engaging holes 412 of the support member 41 until the smaller diameter end thereof abuts against a corresponding one of the roller rods 42. Each of the roller rods 42 is thus retained rotatably in the corresponding one of the engaging holes 412 of the support member 41. Afterward, the main shaft section 611 of the coupling shaft 61 is extended through the main roller 532, the open groove 510 of the first extending wall 514, the mounting seat 531, and the through hole 517 of the base wall 511. The coupling walls 62 are then coupled to the support member 41 by engaging respectively the engaging protrusions 63 with the engaging holes 412. The one of the coupling walls 52 formed with the open hole 621 is then connected to the coupling shaft 61 via the engagement between the open hole 621 and the threaded section 612 of the coupling shaft 61, and is then locked to the coupling shaft 61 using the nuts 64. The coupling unit 6 is thus fixed on the support unit 4.

Referring to FIGS. 2, 4, 5, the threaded member 54 of the holding unit 5 is then loosened from the threaded hole 518, and the mounting seat 531 of the second guide roller module 53 is lifted to allow the cable 3 to be inserted into the receiving space 516 of the main body 51 of the holding unit 5 through the cable opening 519 and placed onto the first guide rollers 521 of the first guide roller module 52. When being reversely rotated to be screwed into the threaded hole 518, the threaded member 54 of the holding unit 5 abuts against and pushes down the mounting seat 531. The main roller 532 and the second guide rollers 533 therefore abut against the cable 3, i.e., the cable 3 is thus clamped between the first guide roller module 52 and the second guide roller module 53.

When the cable shaft 22 of the winch device 2 is driven by the motor 21 to retract the cable 3, the to-be-retracted portion of the cable 3 between the cable shaft 22 and the holding unit 5 is stretched taut. During the process while the cable 3 is wound on the cable shaft 22, the holding unit 5 is in reciprocating motion along the coupling shaft 61 to drive the cable 3 to be wound evenly on the cable shaft 22. The holding unit 5 may also be manually moved along the coupling shaft 61 to facilitate the cable 3 to be wound in the abovementioned manner on the cable shaft 22.

In disassembling the embodiment of the present invention, the threaded member 54 is loosened from the threaded hole 518. The mounting seat 531 of the second guide roller module 53 is lifted to allow the cable 3 to be removed from the receiving space 516 via the cable opening 519. The nuts 64 are then loosened and removed from the threaded section 612 of the coupling shaft 61. The one of the coupling walls 62 formed with the open hole 621 is removed from the support unit 4 and the coupling unit 6 with the open hole 621 being disengaged from the threaded section 612 of the coupling shaft 61 and with the engaging protrusions 63 thereof being disengaged respectively from the engaging holes 412. The other one of the coupling walls 62 is finally removed from the support unit 4 with the engaging protrusions 63 thereof being disengaged respectively from the engaging holes 412.

It is worth mentioning that a distance between the coupling walls 62 can be adjusted due to the engagement between the nuts 64 and the threaded section 612 of the coupling shaft 61. Therefore, the coupling unit 6 is suitable for the support member 41 of different sizes.

To sum up, the holding unit 5 can be quickly coupled to the support unit 4 with the use of the coupling unit 6. In use, the stretched cable 3 can be evenly wound on the cable shaft 22. This invention can be easily installed and dismantled. Furthermore, since the cable 3 can be stretched taut by the cable guide assembly of this invention, the abovementioned hazard to users associated with the prior art may be avoided.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A cable guide assembly adapted for use in a winch device, the winch device including a rotatable cable shaft and a cable wound on the cable shaft, said cable guide assembly comprising:

a support unit including a support member that is disposed to be spaced apart from the cable shaft in a first direction, that extends in a second direction different from the first direction, and that is formed with a cable hole adapted for extension of the cable therethrough, and two roller rods adapted to be disposed at opposite sides of the cable, each of said roller rods being disposed rotatably within said support member, extending in the second direction, and having a portion exposed from said cable hole of said support member;

a holding unit disposed at a side of said support unit that is opposite to the cable shaft for stretching taut a portion of the cable between the cable shaft and said holding unit, and including a main body that defines a receiving space and a cable opening, said receiving space being adapted for extension of another portion of the cable therethrough, said cable opening being disposed at a lateral side of the another portion of the cable received in said receiving space, being in spatial communication with said receiving space, and being adapted for insertion of the cable into and withdrawal of the cable from said receiving space therethrough; and a coupling unit interconnecting said main body of said holding unit and said support member of said support unit.

2. The cable guide assembly as claimed in claim 1, wherein:

said support member of said support unit is further formed with two engaging holes extending therethrough in the second direction, being in spatial communication with said cable hole, and receiving respectively said roller rods; and said support unit further includes four positioning members, two of said positioning members being spaced apart from each other in the second direction, disposed respectively in opposite hole end portions of one of said engaging holes, and retaining a corresponding one of said roller rods therebetween, the other two of said positioning members being spaced apart from each other in the second direction, disposed respectively in opposite hole end portions of the other one of said engaging holes, and retaining a corresponding one of said roller rods therebetween.

3. The cable guide assembly as claimed in claim 2, wherein said holding unit further includes:

a first guide roller module disposed in said receiving space of said main body, and including at least one first guide roller; and a second guide roller module disposed in said receiving space of said main body, and including a main roller cooperating with said at least one first guide roller to clamp the cable therebetween.

4. The cable guide assembly as claimed in claim 3, wherein:

the first and second directions are different horizontal directions; and said main body of said holding unit includes a base wall having vertically opposite ends, first and second connecting walls extending respectively from said opposite ends of said base wall in the second direction, and first and second extending walls extending vertically and respectively from distal ends of said first and second connecting walls toward each other, and cooperating with said base wall and said first and second connecting walls to define said receiving space, said first and second extending walls cooperatively defining said cable opening.

5. The cable guide assembly as claimed in claim 4, wherein:

said first extending wall is disposed over said cable opening and is formed with an open groove that is in spatial communication with said cable opening;

said base wall is formed with a through hole that is registered with said open groove in the second direction and that is in spatial communication with said receiving space;

said second guide roller module further includes a mounting seat that is disposed in said receiving space and that is mounted with said main roller; and said coupling unit includes a coupling shaft extending in the second direction through said main roller, said open groove of said first extending wall, said mounting seat, and said through hole of said base wall, said holding unit being slidable along said coupling shaft, two coupling walls connected respectively to opposite ends of said coupling shaft in the second direction, and four engaging protrusions, two of which protruding respectively from said coupling walls into said opposite hole end portions of said one of said engaging holes, the other two of which protruding respectively from said coupling walls into said opposite hole end portions of said other one of said engaging holes.

6. The cable guide assembly as claimed in claim 5, wherein:

said first guide roller module includes two of said first guide rollers spaced apart from each other in the first direction; and said second guide roller module further includes two second guide rollers disposed respectively at opposite sides of said main roller in the first direction.

7. The cable guide assembly as claimed in claim 4, wherein:

said first connecting wall is formed with a threaded hole that is in spatial communication with said receiving space; and said holding unit further includes a threaded member that extends threadedly through said threaded hole, that abuts against said second guide roller module, and that is operable to adjust a vertical position of said second guide roller module relative to said first guide roller module.

8. The cable guide assembly as claimed in claim 1, wherein said coupling unit includes:

a coupling shaft extending in the second direction, and having a main shaft section that extends through said main body, and a threaded section that is connected to an end of said main shaft section, said holding unit being slidable along said main shaft section of said coupling shaft;

two coupling walls, one of which is connected to a selected position of said threaded section of said coupling shaft, the other one of which is connected to an opposite end of said main shaft section of said coupling shaft opposite to said threaded section; and two engaging protrusions protruding respectively from said coupling walls and connected to said support member of said support unit.

* * * * *